US005928844A

United States Patent [19]

Feeney et al.

[11] Patent Number: 5,928,844

[45] Date of Patent: Jul. 27, 1999

[54] METHOD OF PHOTOGRAPHIC PROCESSING USING SPRAY WASH AFTER BLEACHING

[75] Inventors: Joseph D. Feeney, Fairport; Leslie A. Heiligman, Rochester; David G. Foster, West Henrietta, all of N.Y.

[73] Assignee: Eastman Kodak Company, Rochester, N.Y.

[21] Appl. No.: 09/085,428

[22] Filed: May 27, 1998

[51] Int. Cl.[6] ..... G03C 7/42

[52] U.S. Cl. ..... 430/427; 430/393; 430/430; 430/463

[58] Field of Search ..... 430/427, 463, 430/393, 430

[56] References Cited

U.S. PATENT DOCUMENTS

| | | | |
|---|---|---|---|
| 4,294,914 | 10/1981 | Fyson | 430/418 |
| 4,853,727 | 8/1989 | Ganzke et al. | 354/319 |
| 5,061,608 | 10/1991 | Foster et al. | 430/461 |
| 5,334,491 | 8/1994 | Foster et al. | 430/393 |
| 5,579,076 | 11/1996 | Calisto et al. | 396/627 |
| 5,585,226 | 12/1996 | Strickland et al. | 430/393 |
| 5,652,085 | 7/1997 | Wilson et al. | 430/393 |
| 5,670,305 | 9/1997 | Gordon et al. | 430/460 |

FOREIGN PATENT DOCUMENTS

| | | |
|---|---|---|
| 4226372A1 | 4/1994 | Germany . |
| 2224584 | 5/1990 | United Kingdom . |
| 2292816 | 3/1996 | United Kingdom . |

*Primary Examiner*—Hoa Van Le
*Attorney, Agent, or Firm*—J. Lanny Tucker

[57] ABSTRACT

A color photographic silver halide material is processed effectively without formation of rust after the bleaching step. Bleaching is accomplished using an iron chelate of a biodegradable aminopolycarboxylic acid chelating ligand that has a tendency to form "rust" or ferrous hydroxide in processing baths conventionally used after bleaching, such as washing solution. This tendency to form rust is overcome by spraying the bleached film with a washing solution before fixing, and without immersion of the film in that washing solution.

18 Claims, 2 Drawing Sheets

METHOD OF PHOTOGRAPHIC PROCESSING USING SPRAY WASH AFTER BLEACHING

FIELD OF THE INVENTION

The present invention is directed to photochemical processing of silver halide photographic materials. In particular, it relates to a method of photographic processing whereby processed materials are spray washed between bleaching and fixing wherein bleaching is accomplished using specific biodegradable bleaching agents.

BACKGROUND OF THE INVENTION

The basic image-forming process of color photography comprises the exposure of a silver halide photographic recording material, such as a color film, to light, and the chemical processing of the exposed material to provide a useful image. The chemical processing involves two fundamental steps. The first is a treatment of the exposed silver halide material with a color developing agent wherein some or all of the silver ion is reduced to metallic silver.

The second fundamental step is the removal of the silver metal by one or more steps of bleaching and fixing so that only a dye image remains in the processed material. During bleaching, the developed silver is oxidized to a silver salt by a suitable bleaching agent. The oxidized silver is then dissolved and removed from the element in a fixing step. Most commonly, a wash bath is used between the bleaching and fixing steps to remove chemicals carried over from the bleaching bath.

The most common bleaching agents are complexes of ferric ion and various organic ligands (such as aminopolycarboxylic acids), of which there are hundreds of possibilities, all with varying bleaching activities and biodegradability. Common organic ligands used as part of bleaching agents for color film processing include ethylenediaminetetraacetic acid (EDTA), propylenediaminetetraacetic acid (PDTA) and nitrilotriacetic acid (NTA).

U.S. Pat. No. 4,294,914 (Fyson) describes bleaching and bleach-fixing compositions and a processing method using a ferric complex of one of several alkyliminodiacetic acids, which are known to be more biodegradable than other common organic ligands such as EDTA. Other bleaching agents using similar organic ligands are described in U.S. Pat. No. 5,061,608 (Foster et al) in which the bleaching agent is advantageously combined with specific aliphatic carboxylic acids to reduce dye stains. U.S. Pat. No. 5,334,491 (Foster et al) also describes the use of similar biodegradable bleaching agents in combination with specific levels of bromide ion.

DE 4,226,372 (Tappe et al) describe bleaching solutions containing excess b-alaninediacetic acid (ADA) and a hydroxycarboxylic acid, such as citric acid or tartaric acid, to reduce the precipitation of iron hydroxide (that is, ferrous hydroxide or "rust") in the wash bath following bleaching.

It has been observed by those skilled in the photoprocessing art that it is highly unpredictable as to what compounds might reduce the formation of ferrous hydroxide when any given bleaching agent is used. Photoprocessing labs have tolerated a certain amount of rust in the wash waters in their equipment, but such consumers are becoming more vocal about getting rid of it so their maintenance downtime is reduced.

In processes utilizing methyliminodiacetic acid (MIDA) as the bleaching agent ligand, iron-MIDA dissociation may occur in the wash bath. This rust formation must be controlled by preventing the dissociation of MIDA from ferric ion. In copending and commonly assigned U.S. Ser. No. 08/795,885, filed Feb. 6, 1997, by Foster, a method of photographic processing is described wherein "anti-rust" agents are included in the bleaching solutions in order to control the dissociation of MIDA and similar ligands from ferric ion. Such agents are defined as organic phosphonic or phosphinic acids or salts thereof and were found to be highly effective. However, the "loading" of photographic bleaching solutions with yet another chemical is not the best way to solve such problems, and can create even further concerns, such as environmental concerns.

It is well known to process imagewise exposed silver halide photographic materials in web and sheet form by passing the elements through a photographic processor in a plurality of processing stages or steps, including the various stages noted above. In most instances, the materials are completely submerged or bathed in each photochemical solution to obtain the best photochemical effects. In addition, one or more wash stages may be used between the active photoprocessing stages in order to remove carryover chemicals and to optimize the photochemical effects in each stage. As noted above, a wash stage may be used between bleaching and fixing of color photographic films.

Various attempts have been made to reduce the volumes of the various photochemical solutions, for various reasons. For example, GB 2,292,816 (Earle et al) describes photographic processing in which the volumes of the individual processing solutions are reduced by having each photochemical solution sprayed onto the web of photographic material as it enters the processing tank. This is done to minimize the volumes of processing solutions and to reduce aerial oxidation. In the disclosed process, however, the photographic material is still submerged for a time in the photochemical solution after the spraying operation. Thus, the photographic solution baths are not totally avoided.

There is a need in the industry to reduce the formation of "rust" in processing solutions following the bleaching stage. If this can be done while reducing photochemical processing volumes, additional advantages would be possible.

SUMMARY OF THE INVENTION

The problems noted above have been overcome with a method of processing a photographic silver halide material in a processor, comprising the steps of:

A) bleaching an imagewise exposed and color developed photographic silver halide film using a bleaching solution comprising as a bleaching agent, an iron chelate of a biodegradable aminopolycarboxylic acid chelating ligand, B) spraying the bleached film with a washing solution, and C) fixing the bleached and washed film with a fixing solution, wherein the bleached film is not immersed in the washing solution in step B, and the washing solution is sprayed in step B at a rate of at least 1.2 liters/min.

Iron hydroxide (or "rust") formation is obviated in this invention by avoiding the need to immerse the bleached photographic material in a bath of a washing solution before the fixing step. Thus, the chemicals carried out of the bleaching solution, including the biodegradable bleaching agent, are not deposited in a bath where ferrous hydroxide can form. The problem of rust formation is therefore solved by spraying the bleached film with a washing solution to remove the carryover chemicals. The need for anti-rust agents, as described in U.S. Ser. No. 08/795,885, is thus avoided, reducing the discharge of chemicals to the environment. After spraying, the photographic material can be transported to the fixing and other baths for the remaining photochemical process.

As noted above, the formation of rust is a more serious problem with the use of certain biodegradable chelating ligands in the bleaching agents. The more conventional non-biodegradable chelating agents, such as EDTA, do not readily form rust so the present invention is directed at solving a problem with the biodegradable ligands only.

Besides avoiding the formation of rust, the present invention further allows a reduction in washing solution volume that may be needed in the process compared to conventional processing methods. No volume of washing solution need be maintained in a wash tank between bleaching and fixing. In addition, the sprayed washing solution can be any suitable solution that the user wants to use, including what are known in the art as "stabilizer" or "stabilizing" solutions, conventional washing solutions (including aqueous solutions of surfactants), as well as simply water.

DETAILED DESCRIPTION OF THE INVENTION

Figure 1:
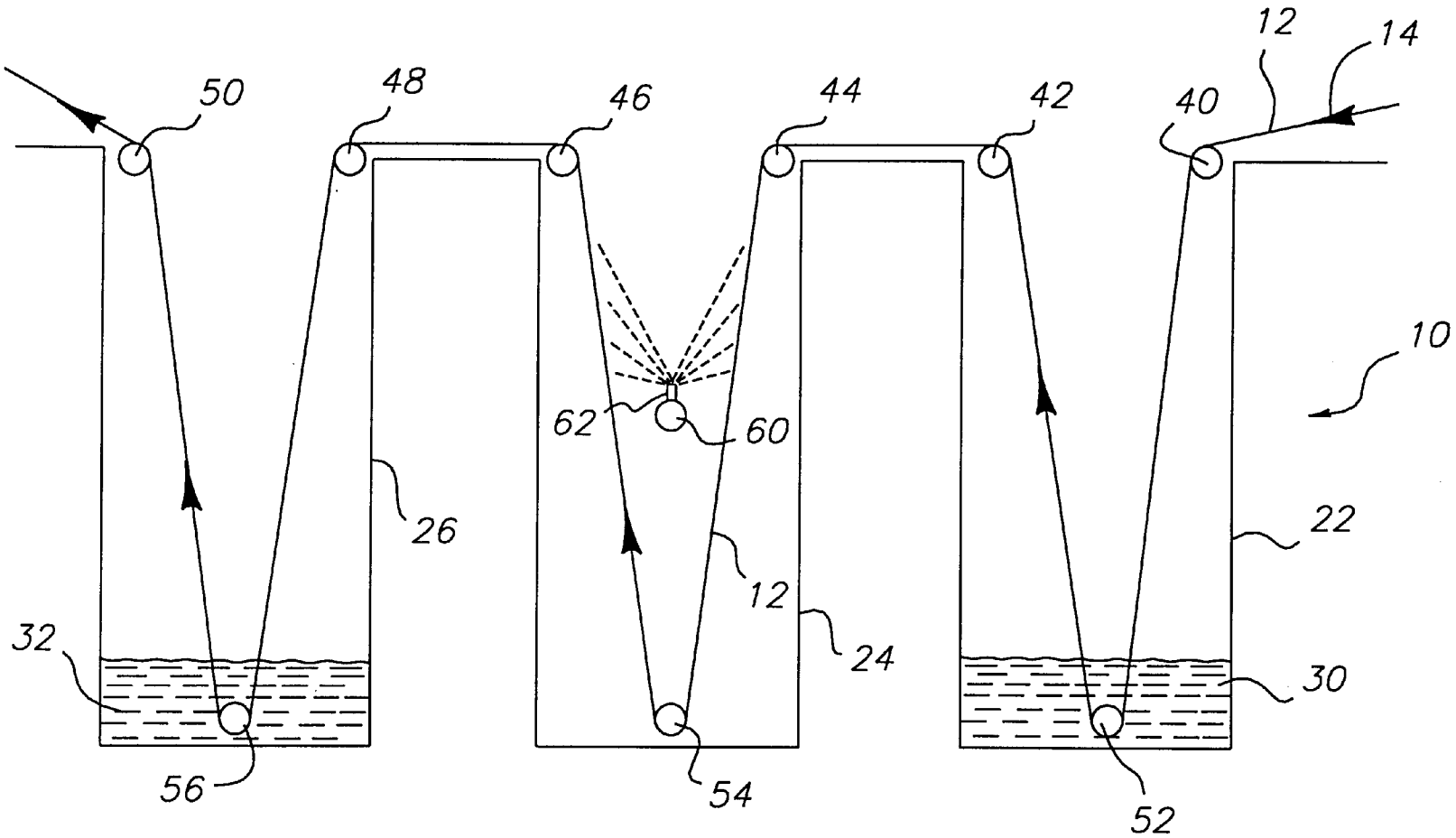
FIG. 1 is a schematic view of the sequence of processing steps used in the present invention, including spraying a washing solution between bleaching and fixing.

The method of this invention includes a bleaching step in which the bleaching agent is a ferric complex of one or more biodegradable aminopolycarboxylic acid chelating ligands. Thus, the resulting complexes can be binary complexes, meaning the ferric ion is complexed to one or more molecules or the same chelating ligand, or ternary complexes in which the ferric ion is complexed to two molecules or two distinct chelating ligands, such as described for example in U.S. Pat. No. 5,670,305 (Gordon et al), incorporated herein by reference. In addition, multiple binary or ternary complexes can be present in the bleaching solution providing multiple ferric bleaching agents.

There are various classes of aminopolycarboxylic acid ligands which can be used to form biodegradable bleaching agents. A preferred class are iminodiacetic acid and its derivatives (or salts thereof). Preferred compounds are alkyliminodiacetic acids that have a substituted or unsubstituted alkyl group having 1 to 6 carbon atoms (such as methyl, ethyl, n-propyl, isopropyl and t-butyl). Particularly useful alkyliminodiacetic acids are methyliminodiacetic acid (MIDA) and ethyliminodiacetic acid (EIDA). These ligands can be used in the free acid form or as a sodium, potassium or ammonium salt. These and other ligands of this class can be represented by structure I:

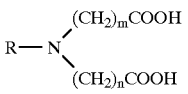

wherein m and n are independently 1, 2 or 3, and preferably each is 1. R is hydrogen, a substituted or unsubstituted alkyl group (having 1 to 10 carbon atoms), a substituted or unsubstituted aryl groups (having 6 to 10 carbon atoms in the aromatic ring), or a substituted or unsubstituted heterocyclic group having from 5 to 10 carbon and heteroatoms (nitrogen, sulfur or oxygen). Preferably, R is hydrogen or a substituted or unsubstituted alkyl group having 1 to 3 carbon atoms, and more preferably, it is hydrogen, methyl or ethyl. Substituents that can be present in the alkyl, aryl and heterocyclic group include any monovalent moiety that does not bind to ferric ion, such as alkoxy (having 1 to 6 carbon atoms), amino, carboxy, phosphono, sulfo, —$SR_1$, —$CONR_2R_3$, and others readily apparent to one skilled in the art, wherein $R_1$ through $R_3$ independently represent hydrogen or a substituted or unsubstituted alkyl group as described above for R.

Useful compounds within the scope of structure I include:

1.

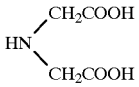

2.

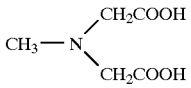

3.

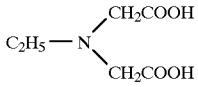

4.

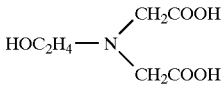

5.

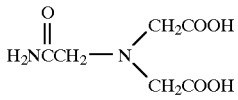

6.

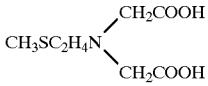

7.

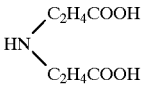

8.

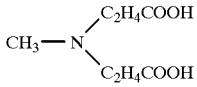

9.

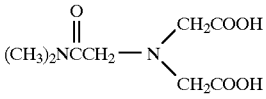

Another class of biodegradable aminopolycarboxylic acid chelating ligands useful to form bleaching agents can be represented by structure II:

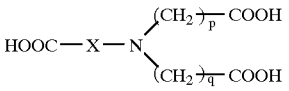

wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group. If substituted, such substituents can be those defined above for the ligands of structure I. Preferably, X is a substituted or unsubstituted alkylene group of 1 to 3 carbon atoms.

Representative compounds within the scope of structure II include:

1.

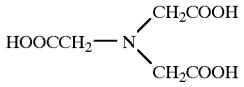

2.

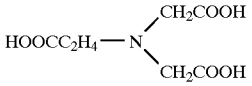

3.

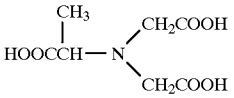

4.

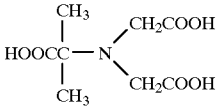

5.

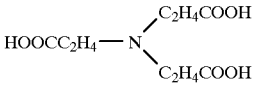

6.

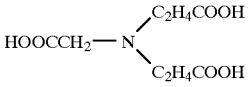

Still another useful class of biodegradable chelating ligands are polyaminodisuccinic and polyaminomonosuccinic acids (or salts thereof). Polyaminodisuccinic acids are compounds having two or more nitrogen atoms, and two of the nitrogen atoms are bonded to a succinic acid group (or salt thereof). Preferably, only two nitrogen atoms each have one succinic acid (or salt) group attached thereto. The compounds have at least two nitrogen atoms, preferably no more than ten nitrogen atoms, and more preferably, no more than 6 nitrogen atoms. The remaining nitrogen atoms (not attached to a succinic acid group) are preferably substituted with hydrogen atoms only, but other substituents can also be present. Most preferably, the succinic acid group(s) are attached to terminal nitrogen atoms, meaning (first or last nitrogens in the compounds). More details about such compounds, along with representative polyaminodisuccinic acid chelating ligands are provided in U.S. Pat. No. 5,652,085 (Wilson et al), incorporated herein by reference. Ethylenediamine-N,N'-disuccinic acid (EDDS) is most preferred in this class of compounds. All isomers are useful, including the [S,S] isomer, and can be used singly or in mixtures.

Polyaminomonosuccinic acids (or salts thereof) are compounds having at least two nitrogen atoms to which a succinic acid (or salt) group is attached to one of the nitrogen atoms. Otherwise, the compounds are defined similarly to the polyaminodisuccinic acids described above. U.S. Pat. No. 5,652,085 also provides more details about such compounds. Ethylenediaminemonosuccinic acid (EDMS) is preferred.

Mixtures of bleaching agents that are ferric ion complexes of EDDS and EDMS are also useful.

Biodegradability is measured by the OECD 301B "Ready Biodegradability: Modified Sturm Test" which is well known in the photographic processing art.

It is not necessary that the ferric ion and the alkyliminodiacetic acid ligand be present in the bleaching solution in stoichiometric proportions. It is preferred that the molar ratio of the ligand to ferric iron be from about 1:1 to about 5:1. In a more preferred embodiment, the ratio is about 2 to about 3 moles of each complexing ligand per mole of ferric ion for the preferred alkyliminodiacetic acid ligands.

Generally speaking, the iron is present in the bleaching solution in an amount of at least 0.001 mol/l, and preferably at least 0.5, and generally up to 1 mol/l, and preferably up to 0.6 mol/l. Lower levels of about 2 g/l are commonly used to bleach color paper. Levels of from about 10 to about 25 g/l are commonly used when rapid bleaching action is desired. Levels of about 13 g/l are commonly used to bleach color reversal materials.

In preferred embodiments, a rehalogenating agent, such as chloride or bromide ions, is present in the bleaching solution. The rehalogenating agent can be present in any effective amount, with useful amounts typically being at least about 0.1 mol/l, and preferably at least about 0.2 mol/l. Bromide ions are preferred, especially when the emulsions being processed are predominantly silver bromide. Chloride or bromide ions can be used in the form of potassium, sodium or ammonium salts.

The bleaching solution can be a bleach-fixing solution and can thus contain one or more silver ion solvents (or fixing agents) including but not limited to, thioethers, thiosulfates and thiocyanates, in conventional amounts.

The bleaching solution can also include other addenda that may be useful in bleaching solutions, such as buffers, metal sequestering agents, anti-scumming agents, antioxidants and anti-foam agents.

Useful buffers include acetic acid, propionic acid, succinic acid, tartaric acid, and other water-soluble aliphatic carboxylic acids known in the art. Acetic acid is preferred. Other buffers, such as borates and carbonates can be used if desired. The bleaching solutions are aqueous acidic solutions preferably having a pH of from about 2 to about 5, but a different pH can be used if desired. A preferred pH is in the range of from about 2.5 to about 4.5.

The bleaching solutions useful in this invention, are essentially free organic phosphonic or phosphinic acids or salts thereof.

The fixing solution used after bleaching is an aqueous composition containing one or more useful fixing agents, with or without fixing accelerators. Useful fixing agents include, but are not limited to, sulfites, thiocyanates, thiosulfates, and mixtures thereof. Fixing accelerators include, but are not limited to, thioethers, and mercaptotriazoles.

The fixing solution can include other addenda commonly useful in such solutions for various purposes, including buffers, metal sequestering agents, and electron transfer agents.

The amount of fixing agent useful in the fixing solution is well known in the art. Other details about fixing solutions are also well known in the art to a skilled photographic processing chemist.

The washing solution that is sprayed during the practice of this invention can be merely water, or a solution comprising one or more surfactants that are commonly used in photographic rinsing solutions, as described for example, in U.S. Pat. No. 3,369,896 (Seeman et al), U.S. Pat. No. 3,545,970 (Gingianni et al) and U.S. Pat. No. 5,534,396 (McGuckin et al), U.S. Pat. No. 5,645,980 (McGuckin et al), U.S. Pat. No. 5,667,948 (McGuckin et al) and U.S. Pat. No. 5,716,765 (McGuckin et al). Particularly useful rinsing solutions include a mixture of surfactants, such as one or more nonionic surfactants with one or more anionic surfactants.

Additionally, the washing solution can be what are known as "stabilizing" solutions including one or more surfactants, and one or more compounds that stabilize dyes formed in color photographic materials during processing. Stabilizing compounds can include, but are not limited to, formaldehyde or formaldehyde precursors such as sodium formaldehyde bisulfite, methylol compounds, as described for example in U.S. Pat. No. 4,927,746 (Schwartz), U.S. Pat. No. 5,529,890 (McGuckin et al), U.S. Pat. No. 5,578,432 (McGuckin et al), U.S. Pat. No. 5,415,979 (Takemura et al) and U.S. Pat. No. 5,716,765 (McGuckin et al), as well as various aldehydes as described for example in U.S. Pat. No. 5,362,609 (Kuwae et al), U.S. Pat. No. 5,424,177 (Kobayashi et al), and U.S. Pat. No. 5,441,852 (Hagiwara et al).

The bleaching and fixing solutions can be used to process the photographic materials described herein using conventional processing equipment and conditions. Generally, the processing equipment includes a series of tanks containing the various processing solutions in sequence. In most of such processing apparatus, the processed materials are generally immersed in the processing solutions. The volumes of the processing solutions can vary from less than 100 ml to 50 liters. Such processing equipment may also include rollers to guide the photographic material through the various processing tanks.

The present invention alleviates the need for an immersing volume of washing solution between bleaching and fixing. While the photographic material can be passed into a separate processing tank between those two processing steps, the intermediate tank used for washing does not hold significant amounts of washing solution. Rather the washing solution is quickly drained. In addition, the washing solution is sprayed onto one or more surfaces of the processed material using one or more nozzles or other spraying means.

FIG. 1 is simplified sectional view of a simple arrangement of processing tanks in processor 10 that can be used in the practice of this invention. Imagewise exposed, photographic material 12 is transported through three processing stages in the direction of arrow 14, each comprising respective processing tanks 22, 24 and 26. Processing tank 22 can include a suitable volume of bleaching solution 30. Processing tank 24 is used for washing according to this invention, and processing tank 26 includes a suitable volume of fixing solution 32. Photographic material 12 is guided and transported through the various tanks by means of upper rollers 40, 42, 44, 46, 48 and 50, and lower rollers 52, 54 and 56. Typically, the lower rollers are below the surface of the processing solution, but in the case of lower roller 54 in processing tank 24, the roller is not immersed in the washing solution because the sprayed solution falling to the bottom of the tank is substantially immediately drained away.

Within processing tank 24 is spray bar 60 extending down into the tank, and in proximity of photographic material 12, and including one or more spray nozzles 62 that apply the washing solution to the photosensitive side of photographic material 12. Spraying can also be accomplished with multiple spray bars, each with one or more spray nozzles. The spray bar(s) can be located at any desirable location in processing tank 24. In FIG. 1, it is shown midway between upper rollers 44 and 46 and lower roller 54.

The processing tanks can also include squeegees near the upper rollers to remove as much of the processing solutions as possible, but squeegees are not essential.

While the processor 10 shown in FIG. 1 is illustrated as having only three processing tanks, typical processors also include processing tanks for color development, final rinsing or stabilizing, and other washing steps within the entire process.

Figure 2:
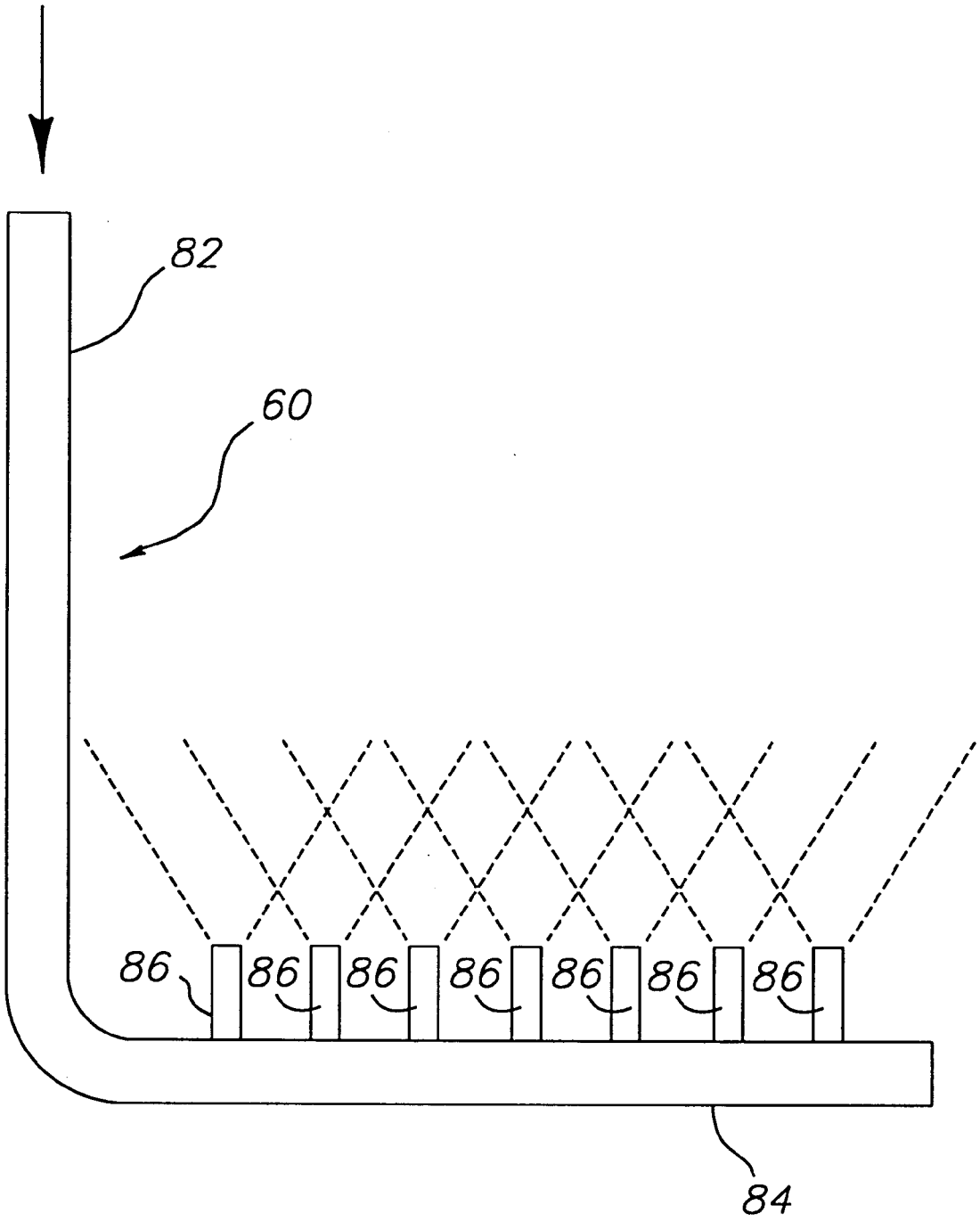
FIG. 2 is a schematic view of a processing wash rack with spray nozzles that can be used in the practice of this invention.

FIG. 2 is a more detailed representation of a typical spray bar that can be used in a processing tank. In FIG. 2, spray bar 60 includes solution intake tube 82 that can be fitted inside a processing tank in any suitable fashion. Intake tube 82 is bent at a 90° angle and spray tube 84 has multiple spray nozzles 86 through which washing solution is delivered to the processed photographic material.

In spraying the washing solution in the practice of this invention, the amount of solution delivered is at least 1.5 liters/min, and preferably at least 7 liters/min. Because one advantage of this invention is reduced volume of washing solution, the upper limit of washing solution rate is generally up to 10 liters/min, and preferably up to 4 liters/min.

Washing solution can be sprayed onto either or both sides of the processed photographic material. Preferably, the spray is directed to at least the photosensitive emulsion sides of the photographic material.

The present invention is useful in the processing of color photographic elements, including photographic color negative and reversal films, motion picture films, and photographic color papers, with or without separate fixing steps. Useful color negative processes include the steps of color development, bleaching, fixing and stabilizing or washing. The steps of a color reversal process are also known. This invention is particularly useful for processing color negative photographic films, including magnetic layer backed color negative films (such as those commercially available from Eastman Kodak Company under the ADVANTIX trademark).

Bleaching according to this invention can be carried out in less than 6 minutes, but even shorter times are possible under certain conditions. For color films, the time may be less than 4 minutes, and more preferably less than 120 seconds. Bleaching temperatures are generally from about 20 to about 40° C.

The bleaching solutions described above can be used as working tank solutions or replenishers, and can be in diluted or concentrated form for a regenerator and/or replenisher. The fixing solutions described above can be similarly used. Both solutions can be replenished at a replenishment rate of less than about 1000 ml/$^2$. Replenishment can be accomplished directly into the processing tank, or a portion of overflow can be mixed with a regenerator to provide a suitable regenerated replenisher. The regenerator concentrate itself can be delivered directly to the processing tank.

The details of such processes including color developing solutions, fixing solutions, stabilizing solutions, conditioning solutions, first developer solutions (for reversal processes), and the color photographic elements processed therein, including emulsions, supports and other details thereof, are well known from hundreds of publications, some of which are listed in *Research Disclosure,* publication 38957, pages 592–639, September 1996, incorporated herein by reference. *Research Disclosure* is a publication of Kenneth Mason Publications Ltd., Dudley House, 12 North Street, Emsworth, Hampshire PO10 7DQ England. Preferred color photographic materials are color negative photographic films.

The following examples are provided to illustrate the present invention, but the invention is not to be interpreted as so limited. Unless otherwise indicated, percentages are by weight.

EXAMPLE 1

A biodegradable bleachable solution was formulated with the following components and amounts:

| | |
|---|---|
| Potassium methyliminodiacetic acid | 70 g/l |
| Potassium bromide | 30 g/l |
| Ferric nitrate (in 100 ml water) | 48.3 g/l |
| Glacial acetic acid | 50 ml/l |
| Water | up to 1 liter |
| pH | adjusted to 4.0 |

The molar ratio of potassium-MIDA to ferric ion in this solution is 2.6:1, and ferric ion was present at 6.67 g/l.

Samples of conventional KODAK ROYAL GOLD 1000 color negative film were imagewise exposed and processed using conventional Process C-41 Color Developer, Fixing and Stabilizer and conditions. Bleaching was carried out using a bleaching solution like that described above. Processing was carried out in a processor having multiple processing tanks like those illustrated in FIG. 1.

Between bleaching and fixing, the samples of film were washed with water that was sprayed onto the emulsion side using a spray bar like that illustrated in FIG. 2. The rate of spray washing was about 1.9 liters/min, and the movement of film sample through the processor was about 275 cm/min. No "rust" or ferrous hydroxide was observed in the tank containing the spray bars.

In contrast, a conventional processing method was used to process the imagewise exposed samples of the same conventional color negative films, in which the processing tank between bleaching and fixing contained a fixed volume (about 65 liters) of water. The film samples were immersed in the wash solution while moving through the processor at a rate of about 275 cm/min. After 1 day, "rust" or ferrous hydroxide was very evident in the wash solution.

EXAMPLE 2

Another bleaching solution useful in the present invention was prepared with the following components:

| | |
|---|---|
| β-Alaninediacetic acid | 70 g/l |
| Potassium bromide | 30 g/l |
| Ferric nitrate (in 100 ml water) | 48.3 g/l |
| Glacial acetic acid | 50 ml/l |
| Water | up to 1 liter |
| pH | adjusted to 3.8 |

Samples of several commercially available color negative films (several KODAK, FUJI, AGFA and KONICA brands) were imagewise exposed and processed as described in Example 1. The wash solution was sprayed onto the emulsion side of the sample films between bleaching and fixing at a rate of about 1.9 liters/min. No rust or ferrous hydroxide was observed in the wash tank containing the spray bar.

The invention has been described in detail with particular reference to preferred embodiments thereof, but it will be understood that variations and modifications can be effected within the spirit and scope of the invention.

We claim:

1. A method of processing a photographic silver halide material in a processor, comprising the steps of:

A) bleaching an imagewise exposed and color developed photographic silver halide film using a bleaching solution comprising as a bleaching agent, an iron chelate of a biodegradable aminopolycarboxylic acid chelating ligand, B) washing said bleached film with a washing solution, and C) fixing said bleached and washed film with a fixing solution, wherein said bleached film is not immersed in said washing solution in step B, and said washing solution is sprayed in step B at a rate of at least 1.5 liters/min.

2. The method of claim 1 wherein said photographic silver halide material is a color negative film.

3. The method of claim 2 wherein said photographic silver halide material is a magnetic layer backed color negative film.

4. The method of claim 1 wherein said photographic silver halide film is a color reversal film.

5. The method of claim 1 wherein said bleaching agent is an iron chelate of iminodiacetic acid or a derivative thereof represented by structure I:

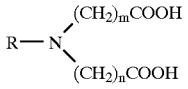

wherein m and n are independently 1, 2 or 3, R is hydrogen, an alkyl group, an aryl group or a heterocyclic group.

6. The method of claim 5 wherein said iminodiacetic acid is an alkyl derivative thereof having an alkyl group of 1 to 6 carbon atoms.

7. The method of claim 5 wherein said iminodiacetic acid is one of the following compounds:

1.

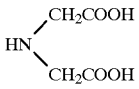

2.

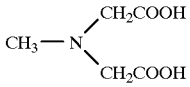

3.

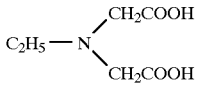

-continued

4.

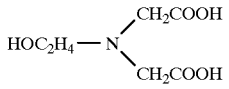

5.

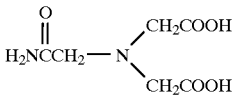

6.

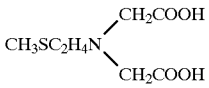

7.

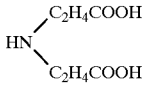

8.

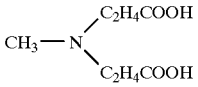

9.

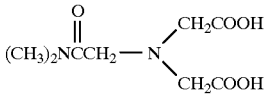

8. The method of claim 5 wherein said bleaching agent comprises an iron chelate of either iminodiacetic acid or methyliminodiacetic acid.

9. The method of claim 1 wherein said aminopolycarboxylic acid ligand is represented by the structure II:

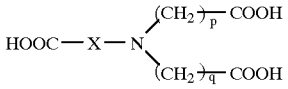

wherein p and g are independently 1, 2, or 3, and X is a divalent linking group that does not bind to ferric ion and does not render said ligand water-insoluble.

10. The method of claim 1 wherein said bleaching agent is an iron chelate of a polyaminodisuccinic or polyaminomonosuccinic acid, or salt thereof, or a mixture of any of these.

11. The method of claim 10 wherein said polyaminodisuccinic or polyaminomonosuccinic acid is ethylenediaminedisuccinic acid or polyaminomonosuccinic acid.

12. The method of claim 1 wherein said bleaching solution is substantially free of polyphosphonic or polyphosphinic acid.

13. The method of claim 1 wherein the amount of iron in said bleaching agent in said bleaching solution is at least 0.001 mol/l, and the molar ratio of chelating ligand to iron is at least 1:1.

14. The method of claim 1 wherein said washing solution is sprayed on said bleached film at a rate of from about 1.5 to about 10 liters/min.

15. The method of claim 1 wherein said bleaching and fixing steps are carried out by immersing said photographic silver halide film in said bleaching and fixing solutions, respectively, without spraying of said solutions.

16. The method of claim 1 further comprising washing said film after step C.

17. The method of claim 16 further comprising contacting said film with a dye image stabilizing solution or final rinse solution after step C.

18. The method of claim 1 wherein said washing solution is sprayed on one side only of said washing step.

* * * * *